US010428586B2

(12) United States Patent
Wagner et al.

(10) Patent No.: US 10,428,586 B2
(45) Date of Patent: Oct. 1, 2019

(54) REAMER ASSEMBLY

(71) Applicants: David B. Wagner, Houston, TX (US); Robert H. Slaughter, Jr., Houston, TX (US); Brent Lane, Houston, TX (US)

(72) Inventors: David B. Wagner, Houston, TX (US); Robert H. Slaughter, Jr., Houston, TX (US); Brent Lane, Houston, TX (US)

(73) Assignee: Inrock Drilling Systems, Inc., Houston, TX (US)

( * ) Notice: Subject to any disclaimer, the term of this patent is extended or adjusted under 35 U.S.C. 154(b) by 355 days.

(21) Appl. No.: 15/366,922

(22) Filed: Dec. 1, 2016

(65) Prior Publication Data

US 2017/0167202 A1 Jun. 15, 2017

Related U.S. Application Data

(60) Provisional application No. 62/267,333, filed on Dec. 15, 2015.

(51) Int. Cl.

| | |
|---|---|
| ***E21B 10/26*** | (2006.01) |
| ***E21B 10/28*** | (2006.01) |
| ***E21B 7/04*** | (2006.01) |
| ***E21B 10/30*** | (2006.01) |
| ***E21B 7/128*** | (2006.01) |
| ***E21B 10/633*** | (2006.01) |

(52) U.S. Cl.

CPC ..... *E21B 10/26* (2013.01); *E21B 7/046* (2013.01); *E21B 7/128* (2013.01); *E21B 10/28* (2013.01); *E21B 10/30* (2013.01); *E21B 10/633* (2013.01)

(58) Field of Classification Search

CPC ..... E21B 10/26; E21B 10/28; E21B 10/30; E21B 10/60; E21B 7/28

See application file for complete search history.

(56) References Cited

U.S. PATENT DOCUMENTS

| | | | | |
|---|---|---|---|---|
| 4,036,314 | A | 7/1977 | Dixon et al. | |
| 5,979,574 | A * | 11/1999 | Osadchuk | E21B 7/046 175/353 |
| 5,992,542 | A | 11/1999 | Rives | |
| 6,386,298 | B1 | 5/2002 | Smith et al. | |
| 6,729,418 | B2 | 5/2004 | Slaughter, Jr. et al. | |

(Continued)

*Primary Examiner* — David J Bagnell
*Assistant Examiner* — Tara E Schimpf
(74) *Attorney, Agent, or Firm* — Keeling Law, LLC; Kenneth A. Keeling; Mark S. Solomon

(57) ABSTRACT

Embodiments of a reamer of the present invention generally include a substantially tubular body sub, a substantially planar base plate having one or more receiving cavities disposed therein, one or more gussets, a fluid chamber, and a plurality of leg/cone assemblies having a leg end and a cone end; wherein the base plate is disposed around the body sub and stabilized by the gussets, and each leg end comprises an exterior surface geometry complementary to the interior surface geometry of a base plate receiving cavity and is insertable into and affixable therein. The receiving cavities are constructed in defined locations and orientations in the base plate and the leg/cone assemblies are precisely formed such that insertion of the leg end into the receiving cavity accurately and precisely disposes the cutting component about the reamer. Embodiments of methods of providing and using an apparatus of the present invention are also provided.

20 Claims, 9 Drawing Sheets

(56) References Cited

U.S. PATENT DOCUMENTS

| | | | | |
|---|---|---|---|---|
| 6,745,858 | B1 * | 6/2004 | Estes | E21B 10/20 175/384 |
| 7,845,437 | B2 | 12/2010 | Bielawa et al. | |
| 8,177,000 | B2 | 5/2012 | Bhome et al. | |
| 8,347,989 | B2 | 1/2013 | Buske et al. | |
| 8,356,398 | B2 | 1/2013 | McCormick et al. | |
| 2002/0088649 | A1 | 7/2002 | Morris, Sr. et al. | |
| 2015/0027785 | A1 | 1/2015 | Lane et al. | |

* cited by examiner

REAMER ASSEMBLY

CROSS-REFERENCE TO RELATED APPLICATIONS

This application claims the benefit of U.S. Provisional Application No. 62/267,333, filed on Dec. 15, 2015, which application is incorporated herein by reference as if reproduced in full below.

STATEMENT REGARDING FEDERALLY SPONSORED RESEARCH OR DEVELOPMENT

Not applicable.

BACKGROUND OF THE INVENTION

This invention relates to an apparatus and method for sub-surface Horizontal Directional Drilling (HDD). HDD is utilized to create an underground pathway without excavation. An example of HDD may be found in U.S. Pat. No. 5,242,026 to Deken, et al., which is incorporated herein by reference in its entirety. One type of apparatus utilized in HDD is a borehole cutter, also known as a "reamer." An example of a reamer may be found in U.S. Pat. No. 6,386,302 to Beaton, which is incorporated herein by reference in its entirety. In various embodiments, reamers employ a plurality of rotary cone drill bits, such as is disclosed, for example in U.S. Pat. No. 5,421,423 to Huffstutler, which is incorporated herein by reference in its entirety.

DESCRIPTION OF THE RELATED ART

Within the HDD industry, the predominant reamer configuration consists of a configuration utilizing leg/cone components, wherein the rotary drill bit has a "cone" end and a "leg" end, wherein the leg end is affixed to the reamer body. Because these apparatuses are typically produced by segmentation ("splitting") of multi-cone roller cone bits, they are often called "split bit reamers." Split bit reamers vary in configuration, however, they are usually constructed in a similar fashion. A typical reamer will consist of (1) a tubular central member very similar to a shortened drill collar, (2) a base plate made centrally located at the midpoint of the tubular member, (3) a top plate proximal to the base plate, (4) a plurality of roller cone leg/cone components affixed to the top plate, evenly spaced apart and aligned with the tubular member, and (5) a substantially fluid tight chamber disposed circumferentially to the tubular member, between the base plate and the top plate, such that flushing fluid can be channeled to the cutting face of the assembled reamer. An example of this structure is disclosed in U.S. Pat. No. 6,386,298 to Smith, et al. Typically, the roller cone leg/cone components are affixed to the top plate by welding. Due to inconsistencies in component placement and/or welding operations, however, many split bit reamers are loaded unequally, leading to operational failure, such as premature bearing failures or uncut hole bottoms resulting in broken cutting elements.

In various embodiments, prior art reamers contain rotary drill bits affixed via insertion into pockets disposed on the exterior surface of the body of the reamer. Examples of this technology may be found in U.S. Pat. No. 7,845,437 to Bielawa, et al., and U.S. Pat. No. 8,347,989 to Buske, et al. These devices may provide more uniformity in leg/cone component attachment, but the inclusion of the exterior surface pocket and corresponding structural modification of the leg requires additional time, material, and expense.

BRIEF SUMMARY OF THE INVENTION

Embodiments of an apparatus of the present invention generally include a plurality of roller cone leg/cone components (assemblies) comprising a leg end and a cone end, wherein each leg end comprises an exterior surface geometry complementary to an interior surface geometry of a receiving cavity formed in a base plate disposed on a reamer body. The receiving cavities are constructed in defined locations and orientations in a base plate. Insertion of the leg in the receiving cavity accurately and precisely disposes the component about the reamer. Once the leg is inserted into the receiving cavity, the component may be affixed to the reamer body by welding or other means. Embodiments of a method of providing an apparatus of the present invention are also provided.

DETAILED DESCRIPTION OF EXEMPLARY EMBODIMENTS OF THE INVENTION

Figure 1:
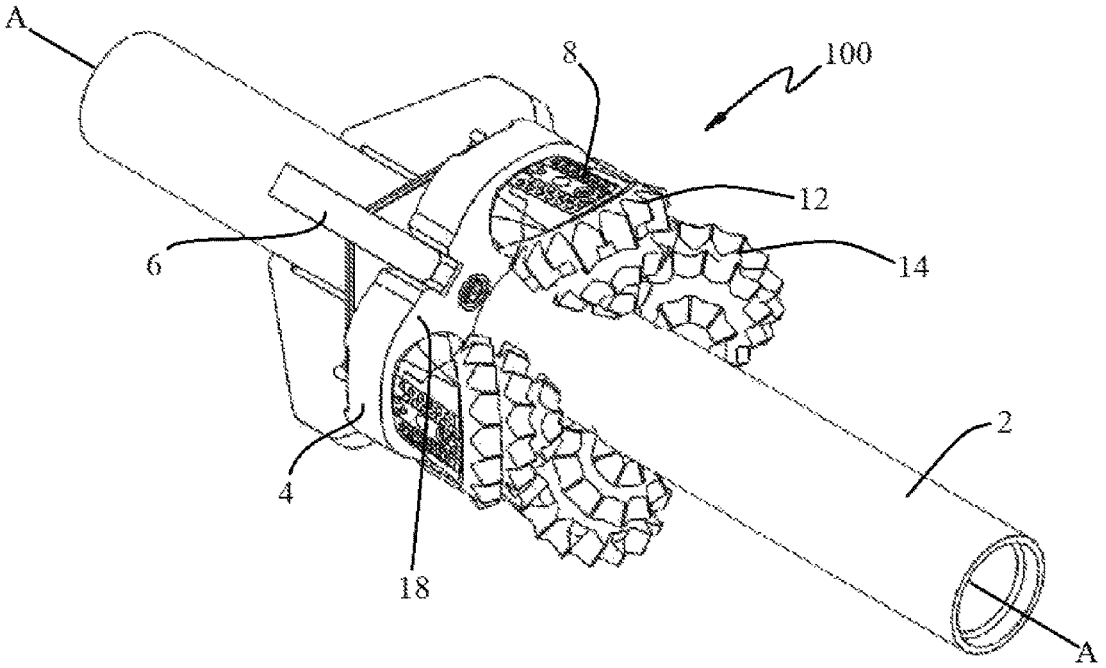
FIG. 1 is an embodiment of a reamer of the present invention.

The exemplary embodiments are best understood by referring to the drawings with like numerals being used for like and corresponding parts of the various drawings. As used herein, longitudinal refers to the axis A-A identified in FIG. 1, and transverse refers to a direction normal to axis A-A of FIG. 1. The directions top and bottom as used in this specification are used for descriptive purposes only, and other orientations are contemplated.

Referring to FIG. 1, an embodiment of a reamer 100 of the present invention is depicted. In the embodiment shown in FIG. 1, reamer 100 comprises a central member (body sub) 2. Body sub 2 may be a substantially tubular structure. In various embodiments, body sub 2 may comprise a constant exterior and/or interior tubular diameter along the length thereof, or comprise varying internal and/or external diameters. Body sub 2 may comprise a single tubular component or comprise an assembly of a plurality of joined tubular components. Body sub 2 may be comprised of any useful material(s), as would be understood by one skilled in the art. In one embodiment, body sub 2 is comprised of a metal material, including but not limited to, plain carbon alloy steel, stainless steel, and/or non-magnetic alloys. In one embodiment, body sub 2 is comprised of plain carbon alloy steel.

Reamer 100 further comprises a base plate 4. In one embodiment, base plate 4 comprises a central orifice 48 (shown in FIG. 4) extending there through, and adapted and configured to allow for insertion of a least a portion body sub 2 there through. Thereby, base plate 4 may be provided at a location along the length of body sub 2. In the embodiment shown in FIG. 1, base plate 4 comprises a substantially planar component disposable substantially perpendicular to the longitudinal axis of body sub 2. Base plate 4 may comprise a single component, as shown in FIG. 1, or an assembly of components cooperatively arranged. Base plate 4 may be comprised of any useful material(s), as would be understood by one skilled in the art. In one embodiment, base plate 4 is comprised of a metal material, including but not limited to, low-carbon plate steel and/or low-carbon alloy steel. In one embodiment, base plate 4 is comprised of low-carbon plate steel. Base plate 4 may be affixed to body sub 2 in any suitable manner as would be understood by one skilled in the art. In one embodiment, base plate 4 is welded to body sub 2. In one embodiment, body sub 2 and base plate 4 comprise a single integrated component.

As further shown FIG. 1, one or more gussets 6 may be employed to support and/or immobilize base plate 4 at a desired location along body sub 2. In other embodiments (not shown) stabilization means other than gussets may be employed, such as, but not limited to, front end stabilization means, such as a "core buster," or front/rear stabilization means, such as a ring stabilizer, as would be understood by one skilled in the art. In one embodiment, gussets 6 comprise substantially planar components disposed substantially parallel to the longitudinal axis of body sub 2 and substantially perpendicular to base plate 4. In one embodiment, gussets 6 are affixable to base plate 4. In one embodiment, gussets 6 are integral to base plate 4. Gussets 6 may be comprised of any useful material(s), as would be understood by one skilled in the art. In one embodiment, gussets 6 are comprised of a metal material, including but not limited to, low-carbon plate steel and/or low-carbon alloy steel. In one embodiment, gussets 6 are comprised of low-carbon plate steel. Gussets 6 may be affixed to body sub 2 in any suitable manner as would be understood by one skilled in the art. In one embodiment, gussets 6 are welded to body sub 2. In one embodiment, body sub 2 and gussets 6 comprise a single integrated component.

As shown in the embodiment depicted in FIG. 1, reamer 100 comprises a plurality of leg/cutter assemblies 8. In one embodiment, each leg/cone assembly 8 comprises a leg segment 10 and a cutter segment 12. (See FIG. 5A). In various embodiments, a cutter segment 12 comprises a rolling cone type bit, as is known in the art (shown in detail in FIG. 5A). In other embodiments (not shown), cutter segment 12 may comprise another cutting structure, including but not limited to, fixed cutter blades utilizing polycrystalline diamond compacts (PDC) (including matrix body PDC bits) and/or synthetic polycrystalline diamond (PCD) bits, fixed cutter blades utilizing cutter picks (point attack tools), drag bits (including step type drag bits and chevron bits), and fixed cutter blades reinforced with hard, wear-resistant materials deposited as a coating or as a weldment. For exemplary purposes only, leg/cutter assemblies 8 are also referred to herein as leg/cone assemblies 8 and cutter segments 12 are also referred to herein as cone segments 12.

In one embodiment, each cone segment 12 comprises a plurality of protrusions 14, as is known in the art. Protrusions 14 may be comprised of any useful wear-resistant material(s), such as, but not limited to, centered tungsten carbide, synthetic PDC, and/or natural diamond, as would be understood by one skilled in the art. In one embodiment, protrusions 14 are comprised of a tungsten carbide material. Protrusions 14, or portions thereof, may be affixed to an exterior surface of cone segment 12 or may be integral therewith. In the embodiment shown in FIG. 1, protrusions 14 are spaced substantially evenly about the surface of cone segment 12 in a plurality of circular patterns, as is typical in the art, although other orientations are possible.

Figure 2:
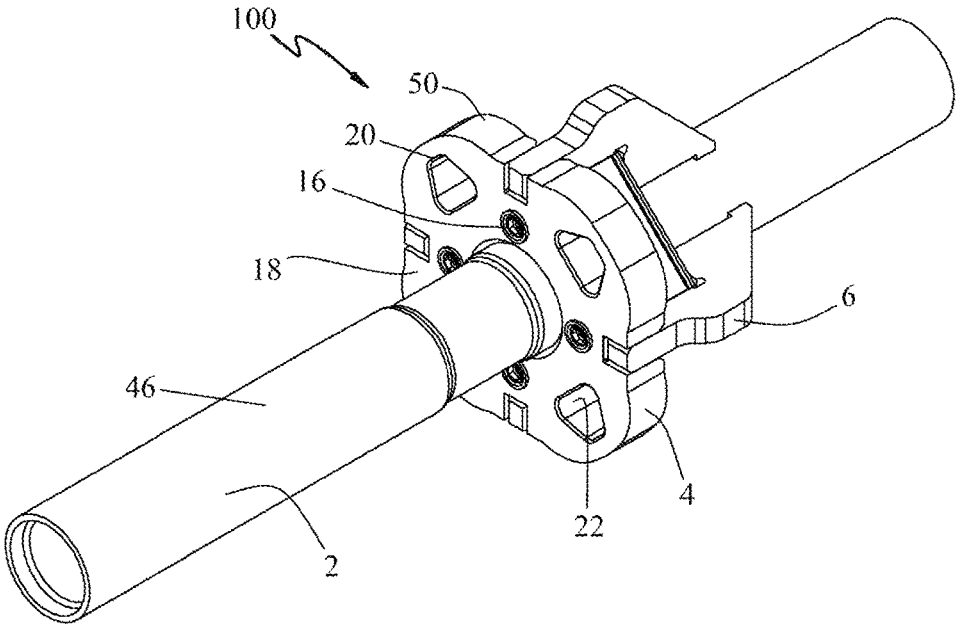
FIGS. 2 and 2A are an embodiment of a portion of a reamer of the present invention, and an embodiment of a substantially tubular body sub thereof, respectively.

Shown in FIG. 2 is an embodiment of reamer 100 without any leg/cone assemblies 8 installed. In the embodiment depicted in FIG. 2, base plate 4 comprises a one or more receiving cavities 20, each open on top surface 18 thereof. Each cavity 20 is precisely located on base plate 4 as a means to enhance the reamer performance for a given application. In one embodiment, each receiving cavity 20 is disposed completely within base plate 4; i.e., no part of a receiving cavity 20 contacts or comprises an outer edge 50 of base plate 4. In other embodiments (not shown), a portion of a receiving cavity may include a portion of outer edge 50 of base plate 4. Receiving cavities 20 comprise an interior surface 22 having a geometry designed to complementarily interface with at least a portion of an exterior surface of leg segments 10 (see FIG. 5A). Receiving cavities 20 allow for insertion of leg segments 10 into base plate 4 and affixation of leg segments 10 thereto.

Figure 3:
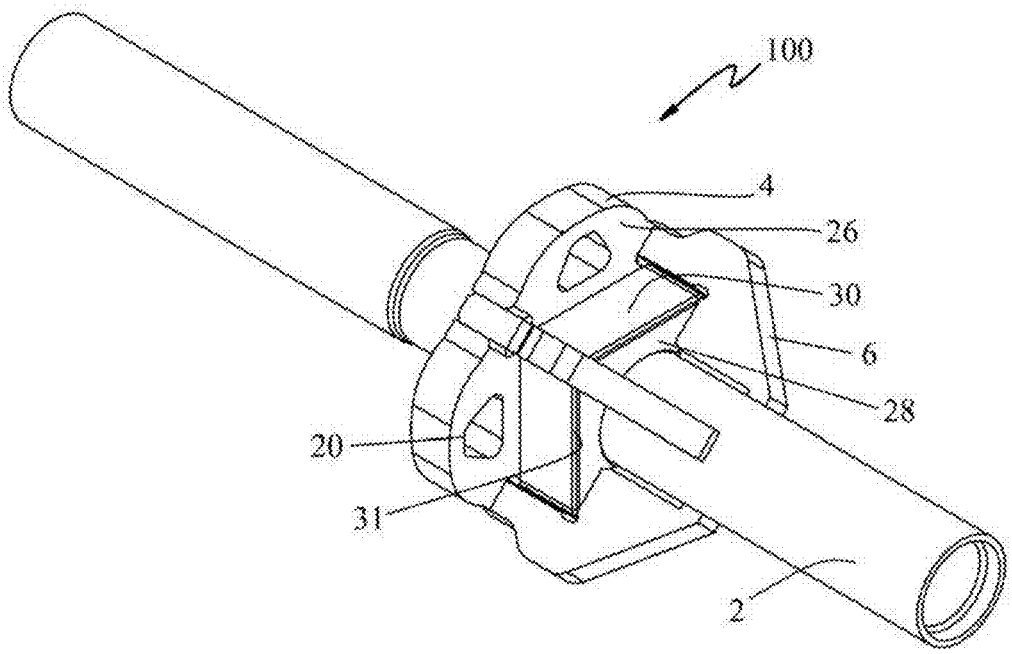
FIG. 3 is a reverse angle view of the portion of a reamer of the present invention depicted in FIG. 2.

FIG. 3 provides a different view of the embodiment of reamer 100 shown in FIG. 2. In the embodiment shown in FIG. 3, receiving cavities 20 extend through a bottom surface 26 of base plate 4, although the invention is not so limited. In other embodiments (not shown), receiving cavities 20 do not extend through bottom surface 26 of base plate 4.

Figure 2A:
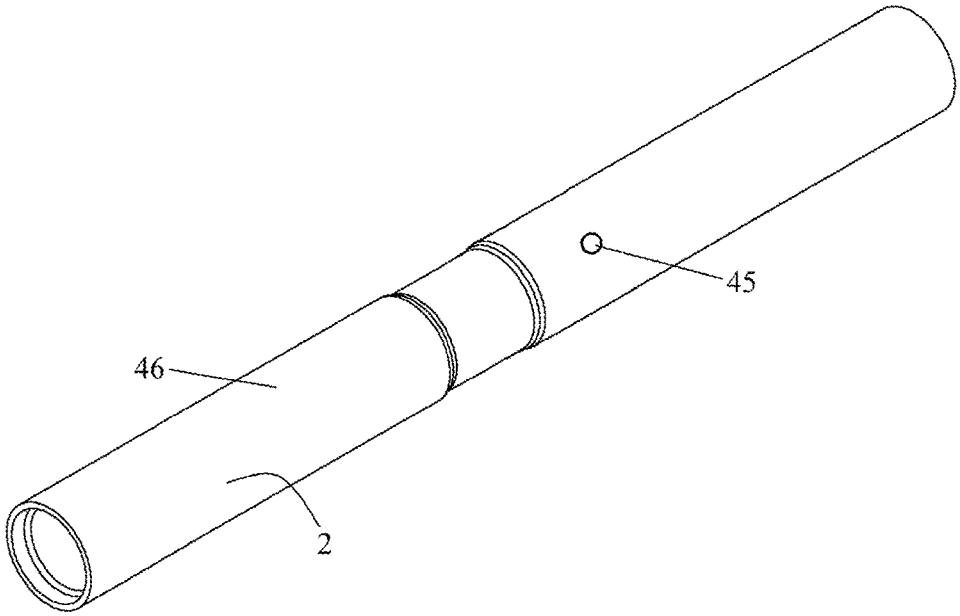

In one embodiment, body sub 2 comprises one or more orifices 45 in the exterior surface 46 thereof (FIG. 2A) which allow for fluid communication between the interior of body sub 2 and one or more fluid chambers 30 disposed at least partially about the exterior surface 46 of body sub 2. In the embodiment shown in FIG. 3, a fluid chamber 30 is aligned substantially parallel to base plate 4 proximate the bottom surface 26 thereof, although other orientations are possible. In the embodiment shown in FIG. 3, fluid chamber 30 is disposed within one or more gussets 6, such that movement thereof is restricted by the one or more gussets 6, although other orientations are possible. A fluid chamber cap 28, attachable to fluid chamber 30, may be provided. In one embodiment, at least one fluid chamber 30 is disposed in fluid communication with one or more fluid conduits 42 (shown in FIG. 4) which extend through base plate 4. In one embodiment, one or more fluid conduits 42 are each in fluid communication with a nozzle assembly 16 (shown in FIG. 2) disposed proximate a top surface 18 of base plate 4. As would be understood by one skilled in the art nozzle assemblies 16 may be utilized to provide circulation fluid (not shown) to clean the cutter assemblies and to flush cutting debris away from the active cutting face and outward of the bore hole. In one embodiment, nozzle assemblies 16 are spaced substantially evenly on the top surface 18 of base plate 4 between leg/cone assemblies 8. Nozzle assemblies 16 may be comprised of any useful material(s), as would be understood by one skilled in the art. In one embodiment, nozzle assemblies 16 may be comprised of a material, including but not limited to, steel, centered tungsten carbide, and/or hard, wear-resistant non-metallic ceramics. In one embodiment, nozzle assemblies 16 comprise a steel tube retaining a nozzle orifice comprised of a centered tungsten carbide material.

Circulation fluid (not shown) may be supplied to reamer 100 as fluid pumped down a drill string (not shown) and into the interior of body sub 2. The fluid is supplied to a fluid chamber 30 through orifice 45 in the exterior surface 46 of body sub 2 that is in fluid communication with the fluid chamber 30. In one embodiment, the fluid chamber 30 is defined by a portion of exterior surface 46 of the body sub 2 forming the interior surface thereof, a fluid chamber cap 28 forming the lower surface thereof, a thin-walled component 31 forming the exterior surface thereof, and a portion of base plate 4 forming the upper surface thereof. In one embodiment, at least one fluid conduit 42 of top surface 18 of base plate 4 comprises a nozzle assembly 16, thereby providing a pathway for the circulation fluid to exit the fluid chamber through the nozzle to provide the cooling and cleaning functions for the reamer. The circulation fluid may comprise water, oilfield drilling fluid (common drilling mud), or any other common circulation fluid used in the oilfield drilling industry. In one embodiment, the purposes of the drilling fluid include flushing cutting debris away from the active cutting face and out of the bore hole, and cleaning and cooling the leg/cutter assembly 8 when in the reamer is in operation.

Figure 4:
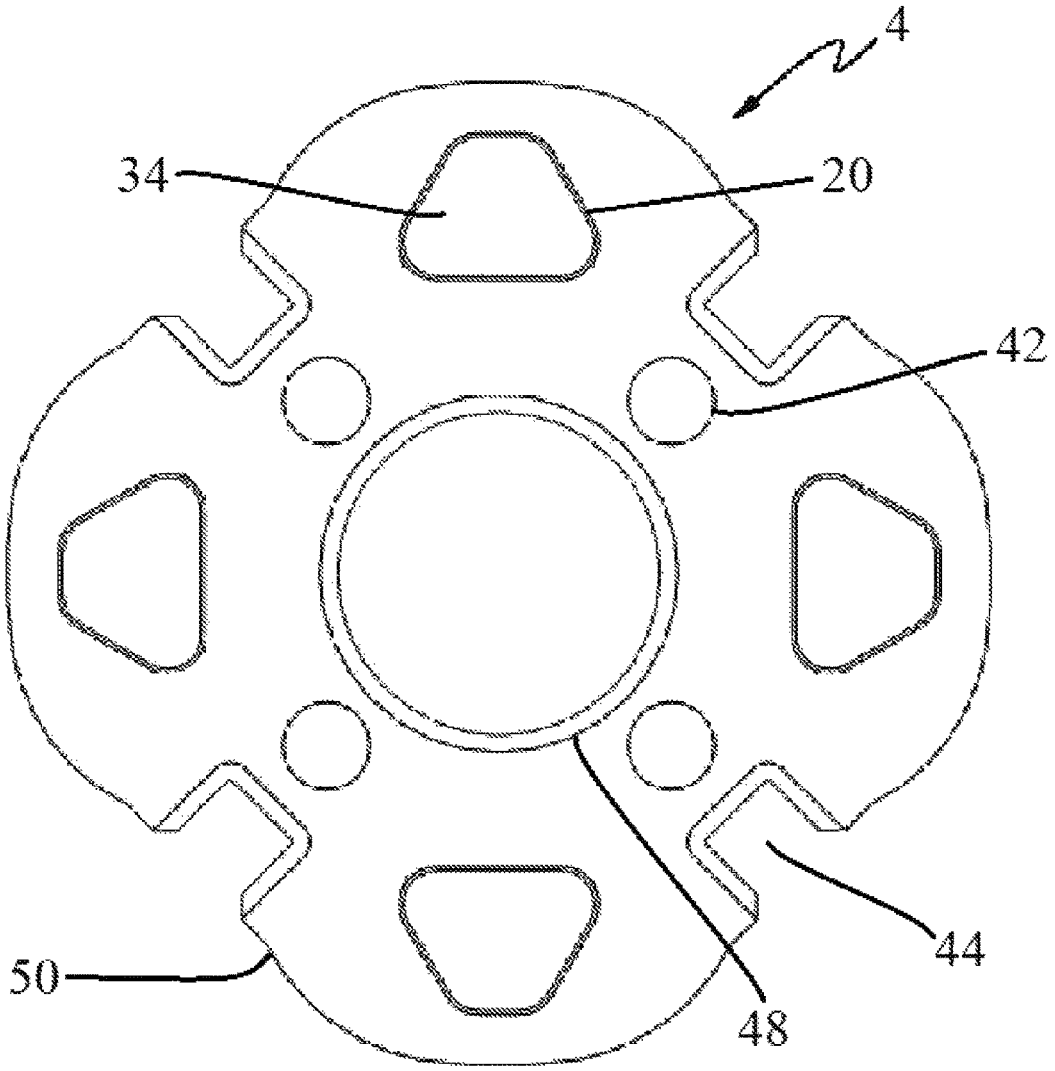
FIG. 4 is a top view of an embodiment of a base plate of the present invention.

FIG. 4 shows a top view of an embodiment of a base plate 4. In this embodiment, each receiving cavity 20 comprises an opening 34 having a substantially trapezoidal shape. The shape of an opening 34 of a receiving cavity 20, however, may be of any useful configuration to affix leg/cutter assembly 8 to base plate 4. In one embodiment cavity 20 comprises an opening 34 having a substantially round shape. In various non-round embodiments, such as the trapezoidal opening 34 geometry depicted in FIG. 4, and additionally including, but not limited to, a substantially rectangular shape (not shown) and/or a substantially triangular shape, (not shown), at least a portion of interior surface 22 of the receiving cavity 20 (see FIG. 6) acts to prevent rotation of leg/cutter assembly 8, in relation to base plate 4, when reamer 100 is in operation. Generally, the shape, depth, and dimensions of a receiving cavity 20 are limited in only by the size of base plate 4. A receiving cavity 20 may comprise a substantially unvarying cross-sectional area throughout, a stepped internal surface structure, and/or other configuration, such as, but not limited to, a beveled or chamfered configuration. In addition, a receiving cavity 20 may comprise an interior surface 22 extending substantially parallel to the longitudinal axis of body sub 2, however, the invention is not so limited and other orientations are employable.

As previously stated regarding the embodiment of the invention depicted in FIGS. 2 and 3, FIG. 4 depicts receiving cavities 20 extending completely through base plate 4, however, the invention is not so limited and one or more receiving cavities 20 of a base plate 4 may extend only partially there through. Additionally, each receiving cavity of a base plate 4 may contain the same shape, depth, and dimensions of the other receiving cavities of the base plate 4, however, the invention is not so limited and one or more receiving cavities of a base plate 4 may vary in shape, depth, and/or dimensions from other receiving cavities of the base plate 4.

Also shown in FIG. 4 are fluid conduits 42 extending through base plate 4. Base plate 4 may comprise one or more fluid conduits 42 as previously described. In the embodiment shown in FIG. 4, base plate 4 comprises gusset connection apertures 44. In one embodiment, a base plate 4 comprises one or more gusset connection apertures 44, each of which may be employed to attach a gusset 6 to base plate 4.

Figure 5A:
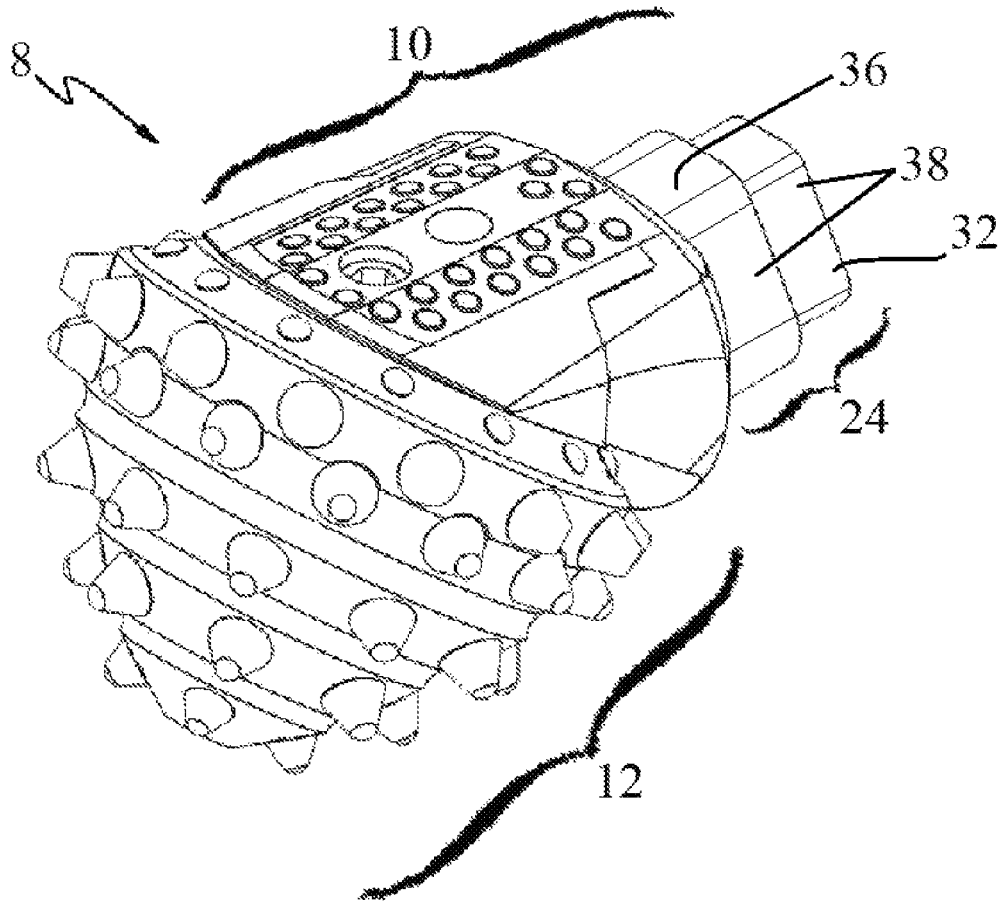
FIG. 5A is an isometric view of an embodiment of a leg/cone assembly of the present invention.
Figure 5B:
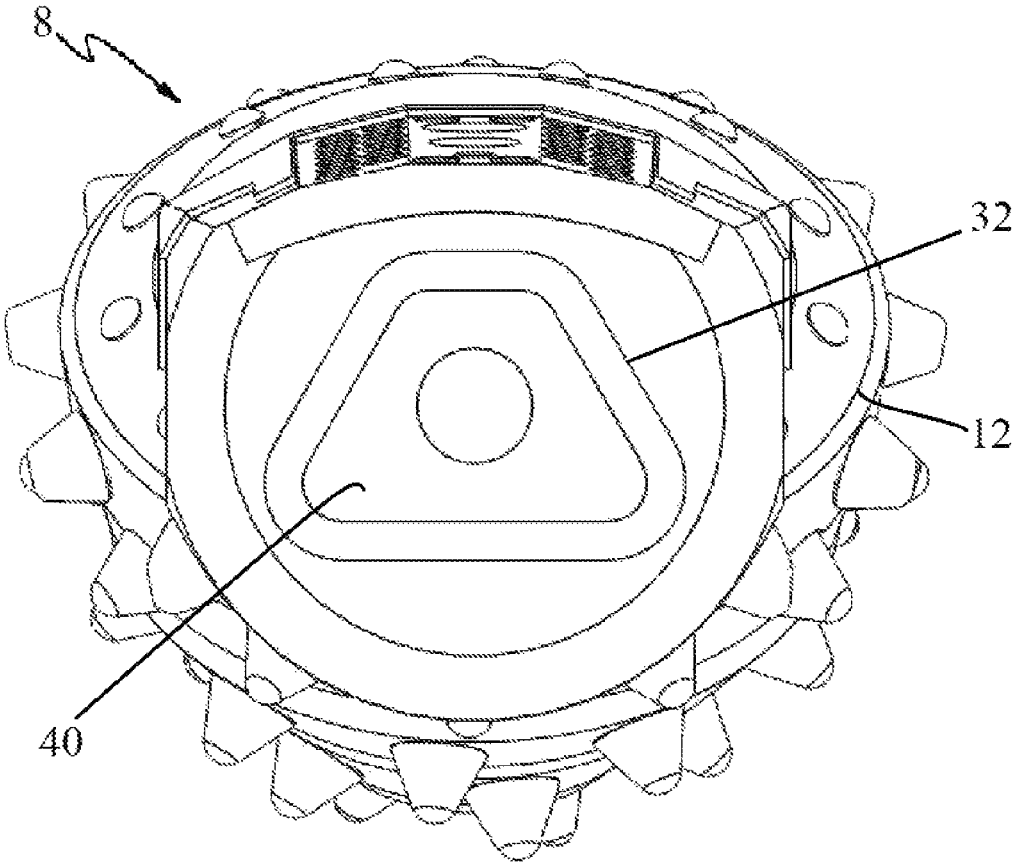
FIG. 5B is a bottom view of an embodiment of a leg/cone assembly of the present invention.

An embodiment of a leg/cone assembly 8 of the present invention is depicted in FIG. 5A. In the embodiment shown in FIG. 5A, leg/cone assembly 8 comprises a leg segment 10 and cone segment 12. A leg segment 10 comprises an insert section 24 configured and adapted to be inserted into a receiving cavity 20. FIG. 5B shows a bottom view of an embodiment of a leg/cone assembly 8 adapted and configured to engage a trapezoidal receiving cavity 20 as is depicted in FIG. 4. In one embodiment, insert section 24 comprises a bottom portion 32 and a top portion 36. In such an embodiment, top section 36 may comprise a surface perimeter greater than the surface perimeter of bottom section 32. In one embodiment, the surface interface between top section 36 and bottom section 32 is tapered. Insert section 24 may comprise a substantially solid construction or a non-solid construction.

Figure 6:
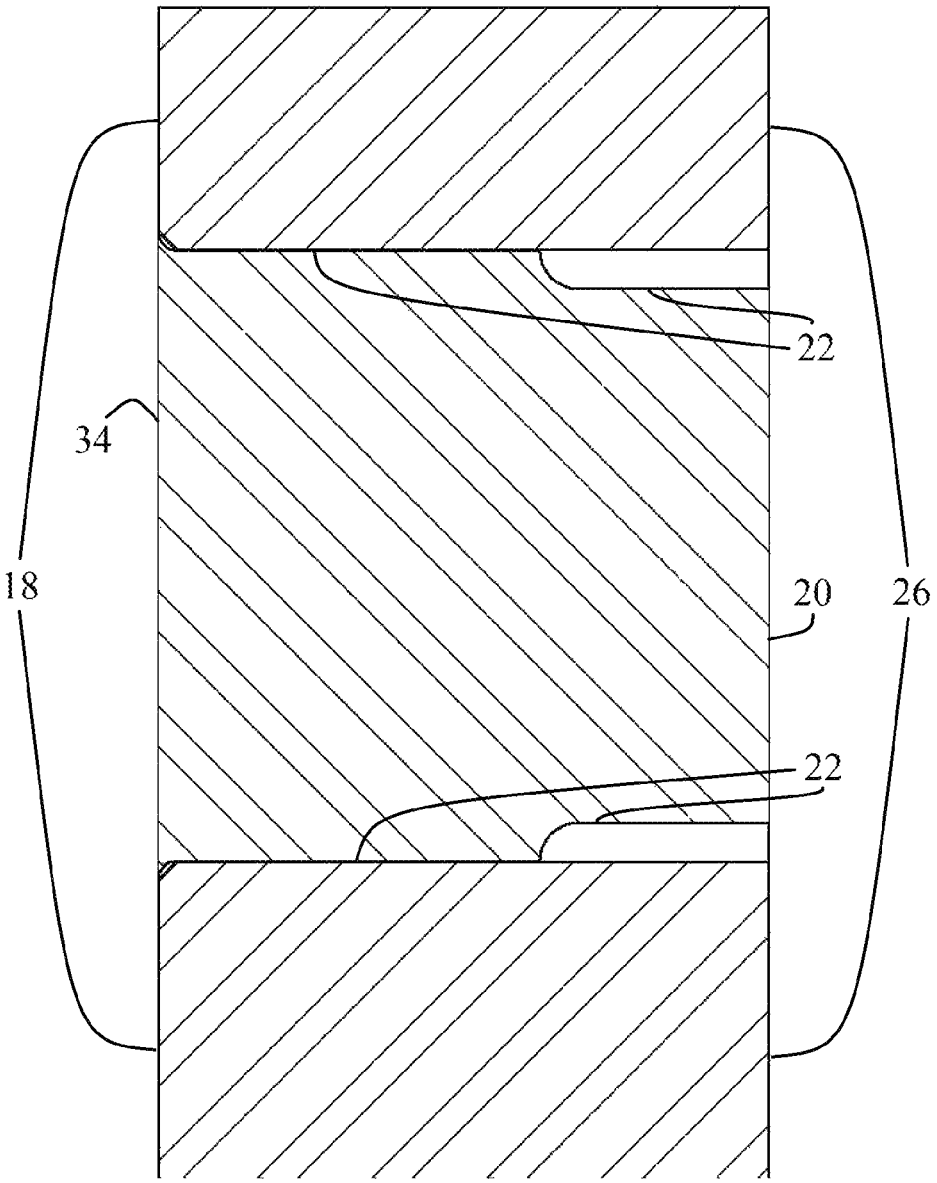
FIG. 6 is a side sectional view of an embodiment of a receiving cavity of the present invention.

In one embodiment, an insert section 24 is adapted and configured to be fittingly inserted into a receiving cavity 20 such that minimal, if any, spacing between the exterior surface 38 of insert section 24 and the interior surface 22 of receiving cavity 20 is provided. For example, to better accommodate the embodiment of insert section 24 shown in FIG. 5A, a receiving cavity 20 may comprise a stepped interior surface 22, as depicted in FIG. 6.

Figure 7A:
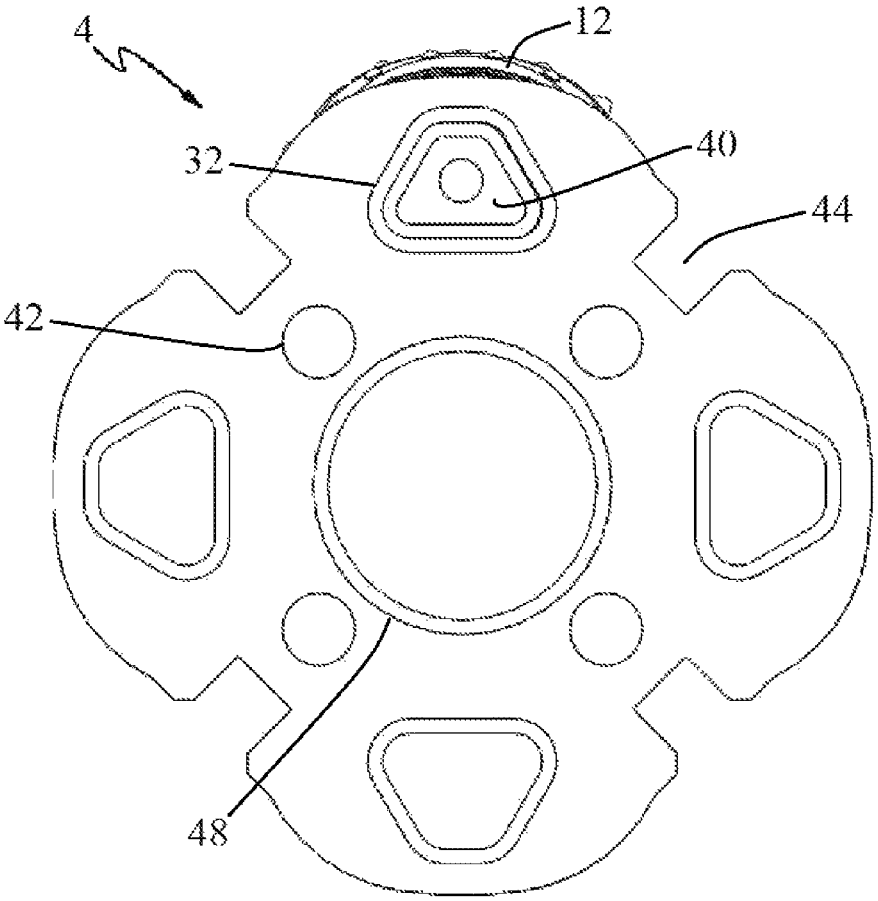
FIG. 7A is a bottom view of an embodiment of a leg/cone assembly of the present invention installed on a base plate of the present invention.
Figure 7B:
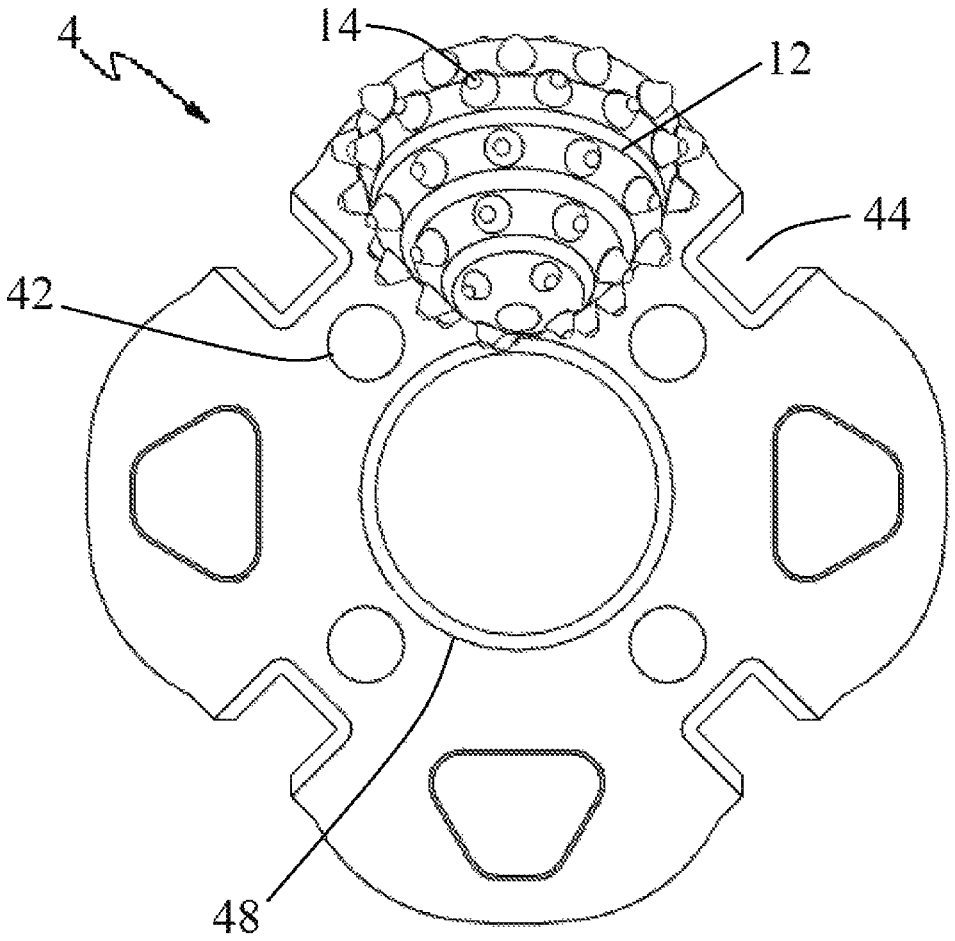
FIG. 7B is a bottom view of an embodiment of a leg/cone assembly of the present invention installed on a base plate of the present invention.

FIG. 7A depicts a bottom view of an embodiment a leg/cone assembly 8 installed in a base plate 4. As is shown in FIG. 7A, in the embodiment depicted, the receiving cavity extends completely through base plate 4 and the bottom surface 40 of insert section 24 is visible in this view. FIG. 7B depicts a top view of an embodiment a leg/cone assembly 8 installed in a base plate 4. In one embodiment, upon insertion of insert section 24 into receiving cavity 20, leg/cutter assembly 8 is affixed to base plate 4 by welding. In one embodiment, the configuration of bottom section 32 in relation to top section 36 depicted in FIG. 5A as a means of forming a weld groove (not shown) facilitates the welding process. Affixation may be performed other than by welding, such as, but not limited to, by mechanical and/or adhesive means. In one embodiment, insert section 24 comprises a mechanism for attachment to base plate 4, such as, but not limited to, a female-threaded socket (not shown) open to the bottom surface 40 of insert section 24.

As is known in the art, leg/cone assemblies may be obtained by "splitting" a multi-cone roller cone bit and modifying the resulting segments, such as by machining, to provide a component suitable for attachment to a base plate. Alternatively, a leg/cone assembly may comprise a newly manufactured part. In various embodiments of the present invention, leg/cone assembly 8 may comprise a newly manufactured component. In other embodiments, leg/cone assembly 8 may comprise a modified segment of a multi-cone roller cone bit. In such embodiments, in order to precisely provide a component accurately configured to be utilized in the present invention, each multi-cone roller cone bit segment may be placed in a fixture which precisely locates the cutting structure of each cone to a known and fixed geometrical location. With the multi-cone roller cone bit segment located securely in the fixture, the lower end (the typically threaded end of a multi-cone roller cone bit) could be machined away and reformed to yield a geometry suitable for precisely attaching the resulting leg/cone segment 8 to the base plate 4 as described in this invention.

Method

In various embodiments, a method of providing a reaming device of the present invention comprises the following steps:

providing a base plate, such as base plate 4, comprising one or more fluid conduits, such as fluid conduit 42, extending there through, a central orifice, such as central orifice 48, extending there through, and one or more receiving cavities, such as a receiving cavity 20;

inserting a substantially tubular component, such as body sub 2, comprising at least one orifice in the exterior surface thereof, such as orifice 45, through the central orifice and positioning the base plate at a location along the length of the body sub;

installing one or more fluid chambers, such as fluid chamber 30, on the exterior surface of the body sub, whereby the fluid chamber is in fluid communication with the interior of the body sub via the body sub exterior surface orifice, and whereby the fluid chamber is also in fluid communication with at least one fluid conduit of the base plate;

affixing one or more base plate stabilization components, such as gusset 6, to the exterior surface of the body sub and/or the base plate, whereby the gusset is disposed proximate a bottom surface of the base plate;

providing one or more leg/cutter assemblies, such as a leg/cone assembly 8, each comprising a leg segment, such as leg segment 10, each comprising an insert section, such as insert section 24, each having an exterior surface, such as exterior surface 38, adapted and configured to be inserted in a receiving cavity, such as a receiving cavity 20; and inserting each insert section into a receiving cavity of the base plate, via an opening of the receiving cavity, such as opening 34, and affixing each insert section therein.

In other embodiments, one or more of these steps may be combined, repeated, re-ordered, or deleted, and/or additional steps may be added. For example, if the fluid chamber requires capping to provide sealing thereof, a fluid chamber capping step may be included or combined with another step. Accordingly, embodiments of a method of the present invention may employ one or more variations of components utilized therein, as disclosed herein.

Operation

In operation, an embodiment of a reamer of the present invention is provided, whereupon a sub-surface HDD process is commenced, as would be understood by one skilled in the art. In one embodiment, a pilot hole is drilled along a pathway that extends from a land surface in a first location, through a sub-surface mass, and back through the land surface of a second location; thereupon, an embodiment of a reamer of present invention may be pulled back through, and/or pushed through, the pilot hole to enlarge the diameter thereof as may be desired. Operation of an embodiment of a split-bit reamer of the present may be carried out as is generally known in the art for such devices.

While the present invention has been disclosed and discussed in connection with the foregoing embodiments, it will be understood that the invention is not limited to the embodiments disclosed, but is capable of numerous rearrangements, modifications, and substitutions of parts and elements without departing from the spirit and scope of the invention.

We claim:

1. A reamer assembly for horizontal directional drilling comprising:
- a substantially tubular component;
- a substantially planar base plate;
- one or more gussets;
- one or more cutting assemblies; and
- one or more fluid chambers;
- wherein:
  - said tubular component comprises one or more orifices in the exterior surface thereof;
  - said base plate comprises:
    - one or more receiving cavities disposed therein, each said receiving cavity comprising an interior surface;
    - one or more fluid conduits extending there through; and
    - a central orifice extending there through; and
  - each said cutting assembly comprises a cutter segment and a leg segment, each said leg segment comprising an outer surface, at least a portion of which is complementary to at least a portion of said interior surface of one said receiving cavity, whereby said leg segment is adapted and configured to be fittingly inserted in said one said receiving cavity from a top side of said base plate;
  - wherein;
    - said tubular component extends through said central orifice, thereby disposing said base plate circumferentially there around;
    - at least one said gusset is affixed to said exterior surface of one or both of said tubular component and said base plate;
      - whereby at least one said gusset is at least partially disposed proximate a bottom surface of the base plate;
    - at least one said fluid chamber is affixed to said exterior surface of said tubular component and provides fluid communication between the interior of said tubular component, via said tubular component exterior surface orifice, and at least one of said one or more fluid conduits; and
    - each said leg segment is disposed at least partially within one said receiving cavity.

2. The reamer assembly of claim 1, wherein:
- no part of at least one said receiving cavity interior surface contacts or comprises an outer edge of said base plate.

3. The reamer assembly of claim 2, wherein:
- at least one said receiving cavity interior surface is non-round.

4. The reamer assembly of claim 3, wherein:
- at least one said fluid chamber is disposed at least partially adjacent to said bottom surface of said base plate.

5. The reamer assembly of claim 4, wherein:
- at least one said fluid chamber is at least partially restrained by at least one said gusset.

6. The reamer assembly of claim 2, wherein:
- at least one said fluid conduit comprises a nozzle adapted and configured to dispel fluid to said top side of said base plate.

7. The reamer assembly of claim 2, wherein:
- at least one said receiving cavity extends completely through said base plate.

8. The reamer assembly of claim 2, wherein:

said receiving cavity interior surface comprises a trapezoidal shape.

9. A method of providing a reamer for horizontal directional drilling comprising:

providing a base plate comprising:

one or more fluid conduits extending there through;

a central orifice extending there through; and one or more receiving cavities disposed therein;

inserting a substantially tubular component, comprising at least one orifice in the exterior surface thereof, through said central orifice;

positioning said base plate at a location along the length of said tubular component;

installing one or more fluid chambers on said tubular component exterior surface, whereby at least one said fluid chamber is in fluid communication with the interior of said tubular component, via said tubular component exterior surface orifice, and whereby said fluid chamber is also in fluid communication with at least one fluid conduit of said base plate;

affixing one or more gussets to the exterior surface of one or both of said tubular component and said base plate;

whereby at least one said gusset is at least partially disposed proximate a bottom surface of the base plate;

providing one or more cutting assemblies, each comprising a leg segment, each leg segment comprising an insert section, each insert section having an exterior surface adapted and configured to be inserted into one said receiving cavity; and inserting each insert section into one said receiving cavity of said base plate, via an opening of that said receiving cavity disposed on a top side of said base plate, and affixing each insert section therein.

10. The method of claim 9, wherein:

no part of at least one said receiving cavity interior surface contacts or comprises an outer edge of said base plate.

11. The method of claim 10, wherein:

at least one said receiving cavity interior surface is non-round.

12. The method of claim 11, wherein:

at least one said fluid chamber is disposed at least partially adjacent to said bottom surface of said base plate.

13. The method of claim 12, wherein:

at least one said fluid chamber is at least partially restrained by at least one said gusset.

14. The method of claim 9, wherein:

at least one said fluid conduit comprises a nozzle adapted and configured to dispel fluid to said top side of said base plate.

15. The method of claim 9, wherein:

at least one said receiving cavity extends completely through said base plate.

16. A method of using a reamer for horizontal directional drilling comprising:

providing a reamer; and using said reamer to perform sub-surface horizontal directional drilling;

wherein said reamer comprises:

a substantially tubular component;

a substantially planar base plate;

one or more gussets;

one or more cutting assemblies; and one or more fluid chambers;

wherein:

said tubular component comprises one or more orifices in the exterior surface thereof;

said base plate comprises:

one or more receiving cavities disposed therein, each said receiving cavity comprising an interior surface;

one or more fluid conduits extending there through; and a central orifice extending there through; and each said cutting assembly comprises a cutter segment and a leg segment, each said leg segment comprising an outer surface, at least a portion of which is complementary to at least a portion of said interior surface of one said receiving cavity, whereby said leg segment is adapted and configured to be fittingly inserted in said one said receiving cavity from a top side of said base plate;

wherein;

said tubular component extends through said central orifice, thereby disposing said base plate circumferentially there around;

at least one said gusset is affixed to said exterior surface of one or both of said tubular component and said base plate;

whereby at least one said gusset is at least partially disposed proximate a bottom surface of the base plate;

at least one said fluid chamber is affixed to said exterior surface of said tubular component and provides fluid communication between the interior of said tubular component, via said tubular component exterior surface orifice, and at least one of said one or more fluid conduits; and each said leg segment is disposed at least partially within one said receiving cavity.

17. The method of claim 16, wherein:

no part of at least one said receiving cavity interior surface contacts or comprises an outer edge of said base plate.

18. The method of claim 17, wherein:

at least one said receiving cavity interior surface is non-round.

19. The method of claim 18, wherein:

at least one said fluid chamber is disposed at least partially adjacent to said bottom surface of said base plate.

20. The method of claim 19, wherein:

at least one said fluid chamber is at least partially restrained by at least one said gusset.

* * * * *